US012808096B2

(12) United States Patent
Yasuda et al.

(10) Patent No.: US 12,808,096 B2
(45) Date of Patent: Nov. 24, 2026

(54) MULTILAYER STRUCTURED SPUN YARN, METHOD FOR PRODUCING THE SAME, FABRIC, AND CLOTHING

(71) Applicant: THE JAPAN WOOL TEXTILE CO., LTD., Kobe (JP)

(72) Inventors: Tomonori Yasuda, Gifu (JP); Akira Okada, Osaka (JP); Hideaki Mogami, Aichi (JP); Takuya Takata, Hyogo (JP)

(73) Assignee: The Japan Wool Textile Co., Ltd., Hyogo (JP)

( * ) Notice: Subject to any disclaimer, the term of this patent is extended or adjusted under 35 U.S.C. 154(b) by 229 days.

(21) Appl. No.: 18/264,482

(22) PCT Filed: Jul. 19, 2022

(86) PCT No.: PCT/JP2022/028007
§ 371 (c)(1),
(2) Date: Aug. 7, 2023

(87) PCT Pub. No.: WO2023/119701
PCT Pub. Date: Jun. 29, 2023

(65) Prior Publication Data

US 2024/0294354 A1 Sep. 5, 2024

(30) Foreign Application Priority Data

Dec. 20, 2021 (JP) ..... 2021-206337

(51) Int. Cl.
*D02G 3/38* (2006.01)
*D02G 3/04* (2006.01)
*D02G 3/36* (2006.01)

(52) U.S. Cl.
CPC ..... *D02G 3/38* (2013.01); *D02G 3/04* (2013.01); *D02G 3/36* (2013.01)

(58) Field of Classification Search
CPC ..... D02G 3/04; D02G 3/32; D02G 3/36
(Continued)

(56) References Cited

U.S. PATENT DOCUMENTS 3,978,267 A * 8/1976 Selwood ..... D02G 3/402 428/394
4,069,656 A * 1/1978 Arai ..... D02G 3/38 57/328

(Continued)

FOREIGN PATENT DOCUMENTS

AU 682320 B 10/1997
CN 1094528 11/2002

(Continued)

OTHER PUBLICATIONS

"Yarn Count Converter." Offtree. Jun. 9, 2025. https://www.offtree.co.uk/yarn-count-converter/ (Year: 2025).*

(Continued)

*Primary Examiner* — Grace Huang
(74) *Attorney, Agent, or Firm* — HSML P.C.

(57) ABSTRACT

A multilayer structured spun yarn includes core component fibers as a multifilament yarn and sheath component fibers with inner and outer layer fibers. The inner layer fibers are untwisted and entirely bundled by the outer layer fibers wound therearound in one direction. The sheath component fibers are a blend of short fibers A with an average fiber length of 10 to 25 mm and short fibers B with an average fiber length of longer than 25 mm and 51 mm or shorter. The multifilament yarn of the core component fibers serves as a connecting yarn. The blending proportion of the short fibers A is preferably 0.1 to 20 mass % with respect to 100 mass % of the multilayer structured spun yarn. The multilayer (Continued)

structured spun yarn can produce a fabric comparable to those of conventional products even though short fibers are used.

9 Claims, 4 Drawing Sheets

(58) Field of Classification Search
USPC ..... 57/210, 224, 225
See application file for complete search history.

(56) References Cited

U.S. PATENT DOCUMENTS

| | | | | |
|---|---|---|---|---|
| 4,912,781 | A * | 4/1990 | Robins | A41D 19/01511 57/200 |
| 5,103,626 | A * | 4/1992 | Morrison | D01H 1/115 57/328 |
| 5,749,212 | A * | 5/1998 | Rees | D02G 3/324 57/224 |
| 6,450,519 | B1 | 9/2002 | Wang | |
| 6,606,846 | B2 * | 8/2003 | Land | D03D 15/513 57/244 |
| 7,155,891 | B2 * | 1/2007 | Bader | D02G 3/367 57/210 |
| 7,310,932 | B2 | 12/2007 | Liao | |
| 7,841,162 | B2 | 11/2010 | Coombs | |
| 9,642,399 | B2 | 5/2017 | Baba | |
| 11,773,515 | B2 * | 10/2023 | Estreicher | D02G 3/32 57/244 |
| 12,344,968 | B2 * | 7/2025 | Izawa | A47K 10/02 |
| 2002/0098354 | A1 | 7/2002 | Land | |
| 2002/0127939 | A1 * | 9/2002 | Hwo | D01F 8/14 428/374 |
| 2003/0074879 | A1 * | 4/2003 | Patrick | D02G 3/12 57/210 |
| 2004/0175542 | A1 | 9/2004 | Miyasaka | |
| 2012/0137649 | A1 * | 6/2012 | Kochmann | D02G 3/367 57/333 |
| 2015/0176160 | A1 * | 6/2015 | Lee | D03D 15/49 428/221 |
| 2015/0368859 | A1 * | 12/2015 | Nishimura | D07B 1/0693 305/170 |
| 2021/0381141 | A1 * | 12/2021 | Ogata | D02G 3/24 |
| 2023/0313861 | A1 * | 10/2023 | Yoshimura | D06M 15/41 474/268 |
| 2024/0279849 | A1 * | 8/2024 | Yasuda | D03D 15/47 |
| 2024/0352629 | A1 * | 10/2024 | Konukoglu | D02G 3/328 |

FOREIGN PATENT DOCUMENTS

| | | | | |
|---|---|---|---|---|
| CN | 110438797 | | 11/2019 | |
| CN | 110603351 | | 12/2019 | |
| CN | 111893612 | | 11/2020 | |
| CN | 112899839 | | 6/2021 | |
| CN | 113005580 | | 6/2021 | |
| CN | 213538222 | U | 6/2021 | |
| CN | 222251222 | U | 12/2024 | |
| EP | 3 109 351 | | 12/2016 | |
| JP | 2-014033 | | 1/1990 | |
| JP | 3-045734 | | 2/1991 | |
| JP | 03045734 | A * | 2/1991 | D02G 3/36 |
| JP | 6-057547 | | 3/1994 | |
| JP | 8-158184 | | 6/1996 | |
| JP | 2616411 | B | 6/1997 | |
| JP | 2806380 | B | 9/1998 | |
| JP | 11-217741 | | 8/1999 | |
| JP | 2005-042206 | | 2/2005 | |
| JP | 2006-132038 | | 5/2006 | |
| JP | 2008-174848 | | 7/2008 | |
| JP | 2009-293136 | | 12/2009 | |
| JP | 2012-102445 | | 5/2012 | |
| JP | 2015-045112 | | 3/2015 | |
| JP | 2015-196928 | | 11/2015 | |
| JP | 5972420 | B | 8/2016 | |
| JP | 6303077 | B | 3/2018 | |
| JP | 6599496 | B | 10/2019 | |
| JP | 6696004 | B | 5/2020 | |
| KR | 10-2012-0058419 | | 6/2012 | |
| WO | 2018/127991 | | 7/2018 | |
| WO | WO-2018127991 | A1 * | 7/2018 | D03D 15/283 |
| WO | 2019/044910 | | 3/2019 | |

OTHER PUBLICATIONS

STIC translation of JPH 0345734 (Year: 2025).*
Extended European Search Report issued in corresponding European Patent Application No. 22922527.1, Oct. 14, 2024.
Extended European Search Report issued in European Patent Application No. 22910431.0, Dec. 17, 2025, 9 pages.
International Search Report issued in International Application No. PCT/JP2022/027224, Sep. 6, 2022, 3 pages.
International Search Report issued in International Application No. PCT/JP2022/028007, Sep. 20, 2022, 6 pages w/translation.
New Spinning Technology: Edited by Wang Jiankun and Zhang Shujie, 1st edition, China Textile Press, 2019, pp. 152-156 w/English translation.
1st Office Action issued in Chinese application No. 202280027823.6 dated Jul. 29, 2025 together with its Machine English translation.
1st Office Action issued in European application No. 22922527.1 dated Jul. 14, 2025.
Office Action issued in corresponding Chinese Patent Application No. 202280014552.0, Feb. 4, 2026, 18 pages w/translation.

* cited by examiner

MULTILAYER STRUCTURED SPUN YARN, METHOD FOR PRODUCING THE SAME, FABRIC, AND CLOTHING

TECHNICAL FIELD

The present invention relates to a multilayer structured spun yarn in which a multifilament yarn is disposed as a core thereof and short fibers are arranged as a sheath thereof, a method for producing the same, a fabric, and clothing.

BACKGROUND ART

Various long-short composite spun yarns in which core component fibers are constituted by filament yarns and sheath component fibers are constituted by short fibers have been conventionally proposed because advantages of both the filament yarns and the short fibers can be utilized. Patent Document 1 has proposed a method for producing a long-short composite spun yarn with a uniform mixed fiber structure, by electrically opening a multifilament yarn and twisting it with short fibers using a ring spinning method. Patent Document 2 has proposed a long-short composite spun yarn in which a filament yarn constituted by a conjugated composite fiber yarn is disposed in a core portion thereof and short fibers are arranged in a sheath portion thereof using a ring spinning method. The inventors of the present invention have proposed a long-short composite spun yarn in which a false-twisted multifilament yarn is disposed in a core portion thereof and a short fiber bundle is disposed in a sheath portion thereof using a ring spinning method (Patent Document 3). Patent Document 4 has proposed a long-short composite spun yarn using a fasciated spinning method.

CITATION LIST

Patent Documents

Patent Document 1: JP 2012-102445A
Patent Document 2: JP 2015-045112A
Patent Document 3: Japanese Patent No. 6696004
Patent Document 4: JP H11-217741A

DISCLOSURE OF INVENTION

Problem to be Solved by the Invention

However, fibers with a short fiber length are not easy to utilize, and it is difficult to form higher value-added products therefrom. Fibers with a short fiber length have issues in that they have poor processability, frequent yarn breakage, and fluffiness, and are difficult to form into spun yarn.

In order to solve the above-mentioned conventional issues, the present invention provides a multilayer structured spun yarn whose yarn properties and properties when the yarn is formed into a fabric are made comparable to those of conventional products by optimizing the yarn structure even when fibers with a short fiber length are contained, a method for producing the same, a fabric, and clothing.

Means for Solving Problem

The present invention is directed to a multilayer structured spun yarn including core component fibers and sheath component fibers, wherein the core component fibers are a multifilament yarn, the sheath component fibers include inner layer fibers and outer layer fibers, and the inner layer fibers of the sheath component fibers are untwisted and entirely bundled by the outer layer fibers wound therearound in one direction, and the sheath component fibers are a blend of short fibers A with an average fiber length of 10 to 25 mm and short fibers B with an average fiber length of longer than 25 mm and 51 mm or shorter.

The present invention is directed to a method for producing the above-described multilayer structured spun yarn, including: opening short fibers A with an average fiber length of 10 to 25 mm and short fibers B with an average fiber length of longer than 25 mm and 51 mm or shorter using a carding machine, and blending the fibers to form a sliver; supplying the sliver to a draft zone of a spinning machine, and drafting the sliver; supplying a multifilament yarn serving as core component fibers to a point on the upstream side of front rollers in the draft zone, and combining the multifilament yarn with the sliver to form a fiber bundle; and supplying the fiber bundle to a spindle disposed at a distance from a discharge portion of the front rollers, false twisting the fiber bundle using a swirling flow, and then taking up the fiber bundle.

The present invention is directed to a woven or knitted fabric using the above-described multilayer structured spun yarn. Also, the present invention is directed to clothing containing the above-described multilayer structured spun yarn or the above-described fabric.

Effects of the Invention

The multilayer structured spun yarn of the present invention includes core component fibers and sheath component fibers. The core component fibers are a multifilament yarn, the sheath component fibers include inner layer fibers and outer layer fibers, and the inner layer fibers of the sheath component fibers are untwisted and entirely bundled by the outer layer fibers wound therearound in one direction. The sheath component fibers are a blend of short fibers A with an average fiber length of 10 to 25 mm and short fibers B with an average fiber length of longer than 25 mm and 51 mm or shorter. Accordingly, it is possible to provide a multilayer structured spun yarn whose yarn properties and properties when the yarn is formed into a fabric are made comparable to those of conventional products by optimizing the yarn structure even when fibers with a short fiber length are contained, a method for producing the same, a fabric, and clothing. That is to say, although the average fiber length of 10 to 25 mm of the short fibers A is shorter than the average fiber length (e.g., 38 mm) of ordinary short fibers for spinning, the short fibers A are conveyed to a swirling flow spindle in a state of being intertwined with the multifilament yarn of the core component fibers and formed into a yarn. The multifilament yarn of the core component fibers serves as a connecting yarn. The obtained multilayer structured spun yarn (fasciated spun yarn) is entirely bundled by the outer layer fibers wound therearound in one direction, and this yarn structure provides high yarn strength, and makes the yarn properties and the properties when the yarn is formed into a fabric comparable to those of conventional products. These properties are suitable for business suits, business uniforms, school uniforms, and the like. Since the method for producing a multilayer structured spun yarn of the present invention is a fasciated spinning method, a yarn can be spun at a speed about 10 to 20 times faster than the ring spinning method, efficiently, reasonably, and at a low cost. Furthermore, a multilayer structured spun yarn can be produced that is uniform, with fewer fluff counts, and has a high hot water shrinkage rate.

DESCRIPTION OF THE INVENTION

Figure 1:
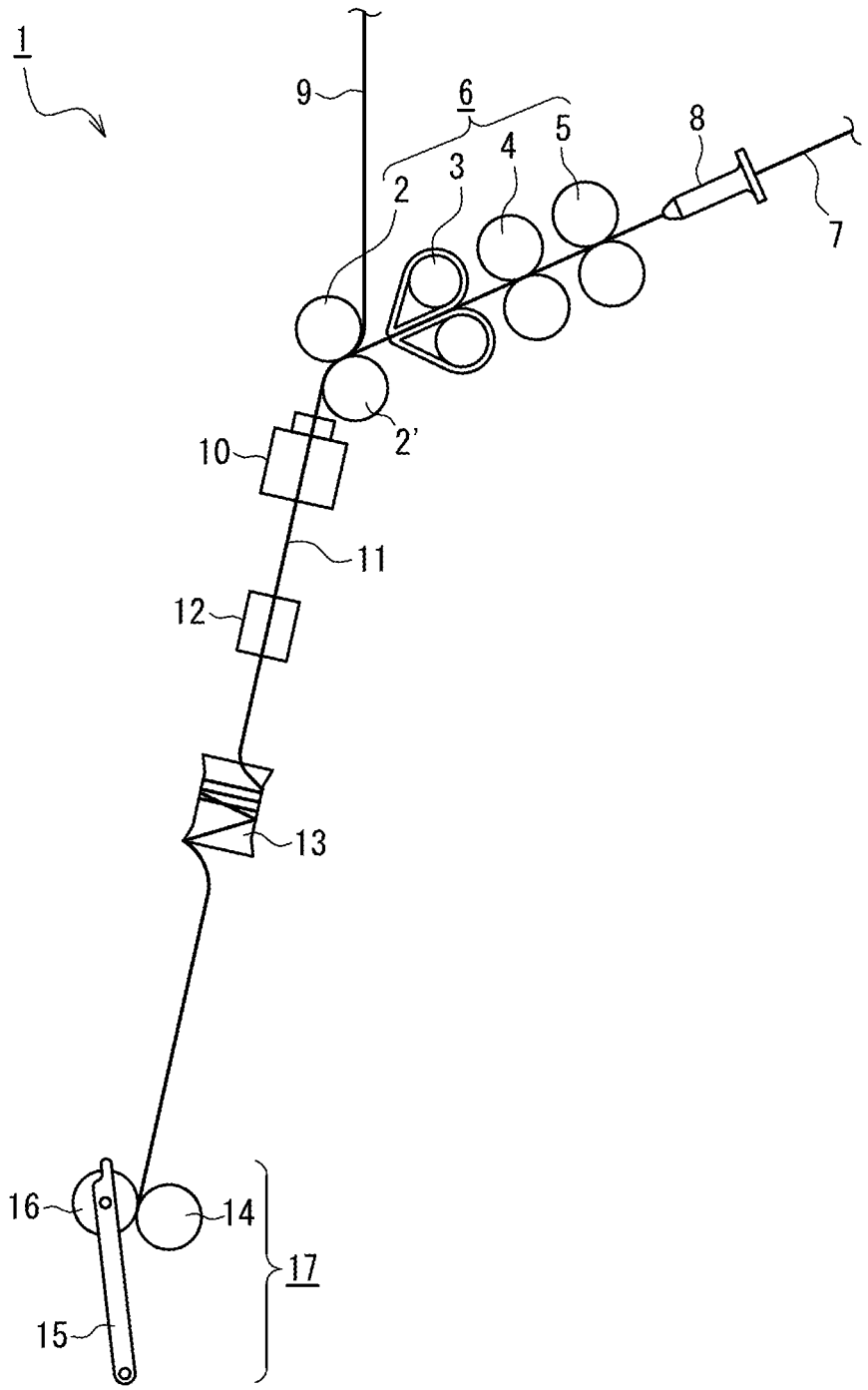
FIG. 1 is a schematic perspective view showing the main portion of a fasciated spinning apparatus for producing a multilayer structured spun yarn according to an embodiment of the present invention.

The inventors of the present invention conducted research on the possibility of utilizing short fibers A with an average fiber length of 10 to 25 mm. First, it was examined whether or not it is possible to form a ring spun yarn from a blend of short fibers A and short fibers B, but yarn formation was found to be difficult due to the short average fiber length of the short fibers A. Next, it was examined whether or not it is possible to form a spun yarn in a similar manner using a fasciated spinning machine, but yarn formation was found to be difficult because the short average fiber length of the short fibers A made it impossible for the fiber bundle to be conveyed from the front rollers to the swirling flow spindle. Thus, attempts were made to form a long-short composite spun yarn (finely twisted union yarn) in which a multifilament yarn is disposed as a core thereof and a short fiber bundle containing short fibers A and obtained by blending the short fibers A and short fibers B is disposed as a sheath thereof, using a fasciated spinning machine. Yarn formation was found to be possible because the multifilament yarn of the core component fibers serves as a connecting yarn and the short fibers A are conveyed to a swirling flow spindle in a state of being intertwined with the multifilament yarn.

The multilayer structured spun yarn of the present invention includes core component fibers and sheath component fibers, the sheath component fibers including inner layer fibers and outer layer fibers. That is, this yarn has a three-layer structure. This strengthens the yarn structure and improves the abrasion resistance and the anti-pilling properties when the yarn is formed into a fabric. Also, this yarn structure prevents a multifilament yarn serving as the core component fibers from projecting outward even when the multilayer structured spun yarn or fabric is hot-water shrunk in the subsequent process, thereby suppressing snarling.

In the present invention, short fibers A with an average fiber length of 10 to 25 mm and short fibers B with an average fiber length of longer than 25 mm and 51 mm or shorter are blended and used as sheath component fibers. The short fibers A have an average fiber length of 10 to 25 mm, and preferably 18 to 22 mm. This average fiber length makes the fibers likely to be caught on a fasciated spinning apparatus. The fasciated spinning apparatus is also referred to as a Vortex spinning apparatus.

The blending proportion of the short fibers A is preferably 0.1 to 20 mass %, more preferably 0.5 to 18 mass %, and even more preferably 1 to 15 mass %, with respect to 100 mass % of the multilayer structured spun yarn. The blending proportion in this range produces higher value-added products without degrading the quality of the products. Specifically, it is possible to optimize the yarn structure and an animal hair fiber blending proportion, and to improve the abrasion resistance, the elasticity, the anti-pilling properties, and the like, when the yarn is formed into a fabric.

The short fibers A are preferably 100 mass % of animal hair fibers or a blend of animal hair fibers and other fibers. The blending proportion of the blend may be set to any value. For example, if the short fibers A are a blend, the blend may be obtained by blending animal hair fibers and fibers other than animal hair fibers in the range of 1:99 to 99:1. The animal hair fibers may be those described later, such as wool. The fibers other than animal hair fibers may be synthetic fibers such as polyester or nylon, regenerated fibers such as rayon, or natural fibers such as cotton.

The short fibers B are preferably 100 mass % of virgin animal hair fibers or a blend of animal hair fibers and other fibers. The blending proportion of the blend may be set to any value. For example, if the short fibers B are a blend, the blend may be obtained by blending animal hair fibers and fibers other than animal hair fibers in the range of 1:99 to 99:1. In the short fibers B, the virgin animal hair fibers preferably have an average fiber length of longer than 25 mm and 35 mm or shorter, and the fibers other than animal hair fibers preferably have an average fiber length of longer than 25 mm and 51 mm or shorter. The short fibers other than virgin animal hair fibers may be any of synthetic fibers, regenerated fibers, and natural fibers. The short fibers are preferably short polyester fibers, short nylon fibers, short cellulose acetate fibers, short cupra fibers, short silk fibers, cotton fibers, hemp fibers, rayon fibers, or the like. Of these short fibers, short polyester fibers are preferable because of their high strength and elasticity.

The multilayer structured spun yarn includes inner layer fibers and outer layer fibers located in the outer layer thereof, and the inner layer fibers are untwisted and entirely bundled by the outer layer fibers wound therearound in one direction. This yarn structure provides high yarn strength, and can improve the abrasion resistance and the anti-pilling properties when the yarn is formed into a fabric. Also, this yarn structure prevents a multifilament yarn serving as the core component fibers from projecting outward, thereby suppressing snarling. These properties are suitable for business suits, business uniforms, school uniforms, and the like.

The multifilament yarn of the core component fibers is preferably an elastic multifilament yarn. The elastic multifilament yarn is preferably a conjugated multifilament yarn or a false twisted multifilament yarn. This improves the elasticity of the fabric. The conjugated multifilament yarn is preferably a polyester conjugated filament yarn obtained through side-by-side composite spinning of polyethylene terephthalate (PET) and polytrimethylene terephthalate (PTT), for example. Examples of such an elastic yarn include a yarn with the product name "Lycra T400 Fiber" (available from Toray Opelontex Co., Ltd.). Other types of elastic yarns that can be used include conjugated yarns of polyethylene terephthalate of two components with different extreme viscosities, conjugated yarns of PET and polybutylene terephthalate (PBT), and conjugated yarns of PTT and PBT. Such polyester conjugated filament yarns have high chlorine and light resistance than PET multifilament yarns. Conjugated multifilament yarns are crimped and become elastic (stretchable) when treated with hot water at about the same temperature as the dyeing temperature. This is why they are also called latently crimpable yarns.

The false-twisted multifilament yarn is preferably a false-twisted multifilament polyester yarn, a false-twisted multifilament nylon yarn, a false-twisted multifilament cellulose acetate yarn, a false-twisted multifilament cupra yarn, a false-twisted multifilament silk yarn, or the like. These yarns can be combined with animal hair fibers to produce higher value-added twisted union yarns. In particular, a false-twisted multifilament polyethylene terephthalate yarn is preferable because of its high strength and elasticity.

The sheath component fibers are preferably a blend of fibers containing the short fibers A and virgin animal hair fibers, or the short fibers A, virgin animal hair fibers, and short fibers other than the virgin animal hair fibers. In the sheath component fibers, the short fibers located in the inner layer are untwisted, and entirely bundled by the short fibers located in the outer layer wound therearound so as to be true-twisted in one direction. The untwisted short fibers in the inner layer and the true-twisted fibers located in the outer layer may be different fibers, or the same fibers that are to be interchanged by migration.

Examples of the animal hair fibers that can be used include wool (sheep fur) (with a fiber length of 30 to 150 mm for merino wool), mohair (goat hair) (with a fiber length of 100 to 300 mm), cashmere (with a fiber length of 40 to 90 mm), camel (camel hair) (with a fiber length of 50 to 70 mm), alpaca (with a fiber length of 100 to 200 mm), vicuna (with a fiber length of 20 to 70 mm), and angora rabbit (rabbit fur) (with a fiber length of 100 to 130 mm). Of these animal hair fibers, wool is preferable because it is the most versatile. Wool may be blended with other animal hair fibers. The animal hair fibers are preferably cut to have an average fiber length of longer than 25 mm and 35 mm or shorter. The blending proportion of the virgin animal hair fibers is preferably 5 to 50 mass %, more preferably 7 to 45 mass %, and even more preferably 10 to 40 mass %, with respect to 100 mass % of the multilayer structured spun yarn. This produces warm woven and knitted fabrics with a good texture. The remainder is preferably virgin fibers (e.g., short polyester fibers) other than animal hair fibers.

The multilayer structured spun yarn preferably contains 10 to 40 mass % of the multifilament yarn of the core component fibers and 60 to 90 mass % of the sheath component fibers with respect to 100 mass % of the multilayer structured spun yarn. The multilayer structured spun yarn more preferably contains 15 to 35 mass % of the multifilament yarn of the core component fibers and 65 to 85 mass % of the sheath component fibers, and even more preferably contains 20 to 30 mass % of the multifilament yarn of the core component fibers and 70 to 80 mass % of the sheath component fibers.

The proportions (in parts by mass) of the fibers in the multilayer structured spun yarn are preferably as follows, for example.

(1) Multifilament yarn: 10 to 40 parts by mass, more preferably 15 to 35 parts by mass, and even more preferably 20 to 30 parts by mass
(2) Virgin animal hair fibers: 5 to 50 parts by mass, more preferably 7 to 45 parts by mass, even more preferably 10 to 40 parts by mass, and even more preferably 20 to 35 parts by mass
(3) Virgin fibers (e.g., short polyester fibers) other than animal hair fibers: 5 to 50 parts by mass, more preferably 7 to 45 parts by mass, even more preferably 10 to 40 parts by mass, and even more preferably 20 to 35 parts by mass
(4) Short fibers A: 0.1 to 20 parts by mass, more preferably 0.5 to 18 parts by mass, and even more preferably 1 to 15 parts by mass The multilayer structured spun yarn of the present invention is preferably a fasciated spun yarn because of its excellent productivity. A fasciated spun yarn is about 10 to 20 times more productive than a ring spun yarn. In particular, a fasciated spun yarn produced using a fasciated spinning apparatus with a single swirl nozzle has less fluff and a stronger yarn structure, which improves the abrasion resistance and the anti-pilling properties when the yarn is formed into a fabric. The fasciated spinning is also referred to as Vortex spinning.

The multilayer structured spun yarn of the present invention preferably has a metric count (single yarn) in the range of 20 to 40 yarn count (fineness: 500 to 250 decitex). The yarn with a metric count in this range is suitable for business suits, business uniforms, school uniforms, and the like. The multilayer structured spun yarn may be a two ply yarn obtained by twisting two yarns together. The two ply yarn preferably has a metric count of 10 to 20 yarn count (fineness: 1000 to 500 decitex). The two ply yarn gives the fabric a superior surface and also increases the strength of the woven fabric.

The woven or knitted fabric of the present invention preferably has a mass per unit area in the range of 50 to 400 g/m$^2$. The mass in this range makes it possible to produce clothing that is lighter and more comfortable to wear. The mass is more preferably in the range of 100 to 350 g/m$^2$, and even more preferably in the range of 150 to 300 g/m$^2$. The woven fabric structure may be any structure such as plain weave, twill weave, satin weave, or other types of derivative weave. The knitted fabric is obtained by weft knitting, circular knitting, warp knitting, or the like, and the knitted fabric structure may be any structure.

Next, an apparatus and a method for producing a multilayer structured yarn according to the present invention will be described with reference to the drawing. In the following drawing, the same reference numerals denote the same constituent elements. FIG. 1 is a perspective view showing the main portion of a fasciated spinning apparatus 1 according to an embodiment of the present invention.

(1) Drafting Process

A draft zone 6 of the fasciated spinning apparatus 1 is constituted by a pair of front rollers 2 and 2', a pair of second rollers 3 with aprons, a pair of third rollers 4, and a pair of back rollers 5. A sliver 7 obtained by blending animal hair fibers and short fibers other than the animal hair fibers and serving as the sheath component fibers passes through a sliver guide 8 and is supplied from the back rollers 5 so as to be drafted in the draft zone 6.

(2) Combining Process of Core Component Fibers and Coating Component Fibers

An elastic multifilament yarn 9 serving as core component fibers is supplied to a point before (on the upstream side of) the front rollers 2 and 2' in the draft zone 6, and combined with a fiber bundle obtained by drafting the sliver 7.

(3) Spun Yarn Forming Process

The combined fiber bundle of the core component fiber yarn and the sheath component fibers is supplied to a spindle 10 disposed at a distance from the discharge portion of the front rollers 2 and 2', and false-twisted by a swirling flow to form a multilayer structured spun yarn (4) Take-Up Process The obtained multilayer structured spun yarn 11 passes through a slub catcher 12, is received by a friction roller 13, and is taken up by a package 16 that is driven by a take-up drum 14 of a winding portion 17 and supported on a cradle arm 15.

The spinning machine used in the production method of the present invention is available under the product name "Murata Vortex Spinner" manufactured by Murata Machinery, Ltd., for example. This machine is characterized by having a yarn speed of 300 to 450 m/min, that is, having a production speed that is about 10 to 20 times faster than that of a ring spinning machine.

Figure 2:
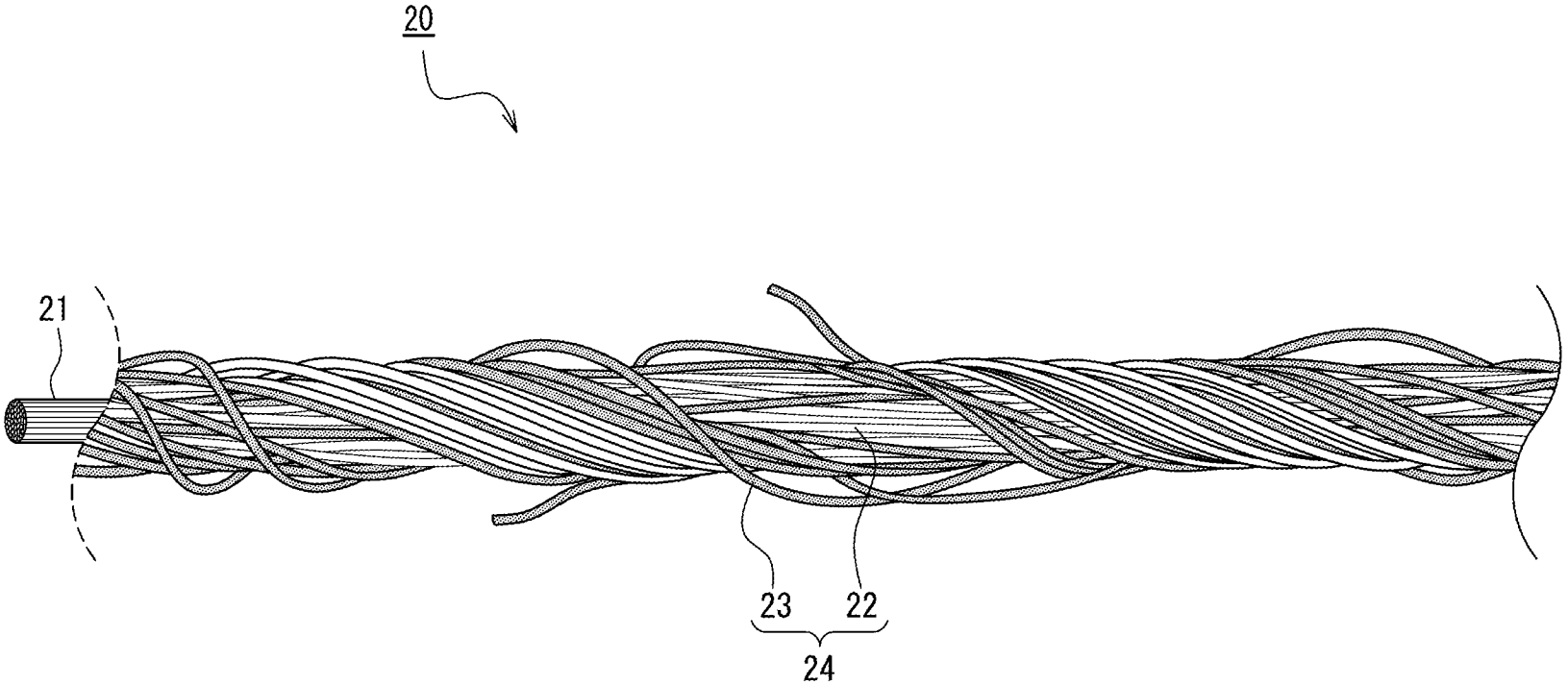
FIG. 2 is a schematic perspective view of the multilayer structured spun yarn according to the embodiment of the present invention.

FIG. 2 shows a multilayer structured spun yarn (fasciated spun yarn) 20 according to an example of the present invention. This yarn is an example in which core component fibers 21 are an elastic multifilament yarn and the blending proportion of wool (total of recycled wool and virgin wool) is set to 35 mass %. Sheath component fibers 24 are blended fibers of short fibers A (a blend of 50 mass % of wool and 50 mass % of short polyester fibers), and short fibers B (virgin wool, and virgin short polyester (PET) fibers). In the sheath component fibers 24, inner layer fibers 22 and wound fibers 23 in the outer layer are both in a state of blended fibers of wool and short PET fibers, and arranged as the inner layer fibers 22 and the wound fibers 23 in the outer layer. The wound fibers 23 in the outer layer are true-twisted in one direction and entirely bundle the fibers. Accordingly, there is little fluffing or sagging, and the fibers are not detached even when subjected to abrasion, and thus a strong yarn state is maintained. In the description above, the "one direction" refers to wound fibers being S-twisted or Z-twisted, and does not mean that the twist angle is the same. Whether wound fibers are S-twisted or Z-twisted is determined by the direction of the pressurized swirl flow of the spinner of the fasciated spinning machine. This multilayer structured spun yarn (fasciated spun yarn) 20 has a three-layer structure consisting of the core component fibers 21, and the untwisted inner layer fibers 22 and the wound fibers 23 in the outer layer that are included in the sheath component fibers 24. This yarn structure provides high yarn strength. Furthermore, wool in the inner layer is coated and protected by short PET fibers in the outer layer, which prevents damage to the wool.

As is clear from FIG. 2, the wound fibers in the outer layer are tightly wrapped around the core component fibers and the inner layer fibers of the sheath component, which contributes to improvements in the abrasion resistance, the weft elasticity, and the anti-pilling properties, when the yarn is formed into a fabric.

EXAMPLES

Hereinafter, the present invention will be described in more detail by way of the examples. The invention is not limited to the following examples.

The measuring methods in the examples and the comparative examples of the present invention are in conformity with JIS or industry standards.

Example 1

1. Fibers Used (1) Core Component Fibers

Polyethylene terephthalate (PET) and polytrimethylene terephthalate (PTT) were subjected to side-by-side composite spinning in a ratio of 50:50 to form a polyester conjugated multifilament yarn (the product name: Lycra T400 Fiber (available from Toray Opelontex Co., Ltd.), the total fineness: 83 decitex, the number of constituent fibers: 34, black dope dyed product), which was used as the core component fibers.

(2) Sheath Component Fibers

The following fibers were carded and blended.

(i) Short Fibers A

As the short fibers A, a blend of fibers from used clothing were used as recycled shoddy, cut using a cutter machine, and unraveled using a garnet machine to obtain a web. The average fiber length was 20.7 mm, and the blending proportion in mass ratio was wool:polyester (PET)=50:50.

(ii) Short Fibers B

Virgin Wool

A fiber bundle (20 g/m) of merino wool with an average diameter of 22 μm and an average fiber length of 80 mm was square-cut to have an average fiber length of 28 mm.

Virgin Short PET Fibers

Black dope dyed fibers made of polyethylene terephthalate (PET) with a fineness of 1.56 decitex were square-cut (to have an average fiber length of 38 mm).

These recycled shoddy, wool, and short PET fibers were uniformly blended in the specified proportions shown in Table 1 using a carding machine, and processed into a sliver according to the usual method.

2. Production of Multilayer Structured Spun Yarn

Figure 3:
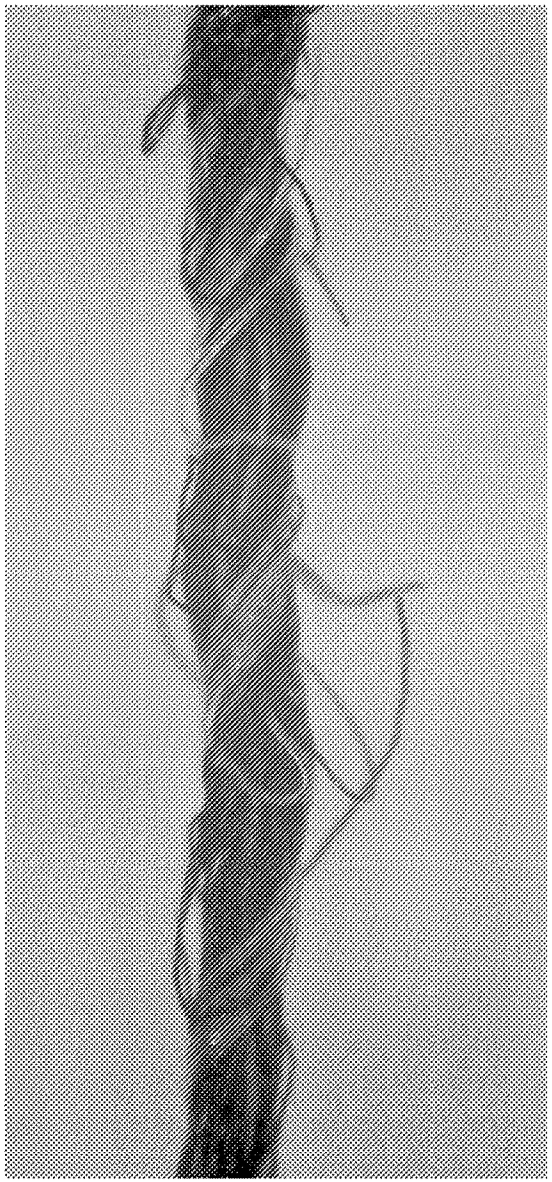
FIG. 3 is a photo (200× magnification) of the multilayer structured spun yarn as viewed from a side according to an example of the present invention.

A multilayer structured fasciated spun yarn was produced from the polyester conjugated multifilament yarn as the core component fibers and the fiber bundle (sliver) obtained by blending wool and short PET fibers as the sheath component fibers, at a speed of 300 m/min using a machine with the product name "No. 870, Murata Vortex Spinner" manufactured by Murata Machinery, Ltd. shown in FIG. 1. The metric count of the obtained yarn was 36 yarn count (278 decitex). This yarn is indicated as 1/36 when used as a single yarn. This yarn as a whole contained 35 mass % of wool and 65 mass % of polyester. FIG. 3 shows a photo of the obtained multilayer structured fasciated spun yarn as viewed from a side.

Comparative Example 1

The production was performed in the same way as that of Example 1, except that recycled shoddy was not added.

The proportions of the fibers and the properties of the obtained fasciated spun yarns are as shown in Table 1.

TABLE 1

| | | Ex. 1 | Com. Ex. 1 |
|---|---|---|---|
| | Metric count (yarn count) | 1/36 | 1/36 |
| Blending proportion | Conjugated yarn (mass %) | 30 | 30 |
| | Virgin wool of short fibers B (mass %) | 27.5 | 35 |
| | Short PET fibers of short fibers B (mass %) | 27.5 | 35 |
| | Short fibers A (mass %) | 15 (w:p = 1:1) | — |
| | Strength (g) | 513.2 | 519 |
| | Elongation (%) | 14.3 | 15.8 |

As is clear from Table 1, the fasciated spun yarn of Example 1 had properties comparable to those of the fasciated spun yarn of Comparative Example 1.

Examples 2 and 3

Woven fabrics were produced under the following conditions.

(1) Weft Yarn

The multilayer structured spun yarn of Example 1 was used.

(2) Warp Yarn

A ring spun two ply yarn containing 50 mass % of wool and 50 mass % of short PET fibers and having a metric count of 48 yarn count (208 decitex), that is, a metric count of 2/48 yarn count (417 decitex), was used.

(3) Production of Woven Fabric

Figure 4:
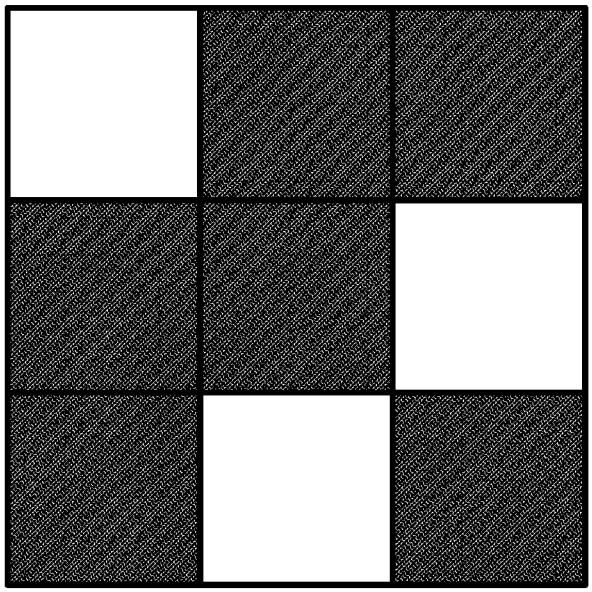
FIG. 4 is a woven structure diagram according to the example of the present invention.

A woven fabric with a 2/1 twill structure shown in FIG. 4 was woven from the warp yarn and the weft yarn using a rapier loom. In FIG. 4, structure points at which the warp yarn is raised and sunken are respectively shown in black and white. The obtained woven fabric was dyed using acid dyes to dye the wool while increasing the temperature from room temperature (25° C.) to 100° C. over 75 minutes, immersed in hot water at 100° C. for 45 minutes, and then washed.

Comparative Example 2

The production was performed in the same way as that of Example 2, except that the fasciated spun yarn of Comparative Example 1 was used as the weft yarn.

The conditions and results are summarized in Table 2.

TABLE 2

| | | Test item | | | |
|---|---|---|---|---|---|
| | | Ex. 2 | Ex. 3 | Com. Ex. 2 | Test method |
| Weft Yarn: (metric count) | | 1/36 | 1/36 | 1/36 | |
| Warp Yarn: (metric count) | | 2/48 | 2/48 | 2/48 | |
| Woven fabric structure | | 2/1 Twill | 2/1 Twill | 2/1 Twill | |
| Mass (g/m$^2$) | | 214.0 | 213.6 | 213.1 | JIS L1096-8.3.2 (A method) |
| Yarn density | warp (number per 10 cm) | 284 | 292 | 290 | JIS L1096-8.6.1 |
| | weft (number per 10 cm) | 268 | 264 | 256 | |
| Tensile strength | warp (N) | 1070 | 1060 | 1040 | JIS L1096-8.14.1 |
| | weft (N) | 624 | 594 | 624 | (A method) |
| Tensile elongation | warp (%) | 47.7 | 48.6 | 50.9 | JIS L1096-8.14.1 |
| | weft (%) | 52.7 | 52.5 | 52.9 | (A method) |
| Tear strength (D method) | warp (N) | 54.4 | 59.1 | 56.0 | JIS L1096-8.17.4 |
| | weft (N) | 25.5 | 24.9 | 26.0 | (D method) |
| Abrasion resistance (surface) | | 328 | 333 | 410 | JIS L1096-8.19.1 |
| C1000 (times) | | | | | (A-1 method) |
| Elongation (elasticity) | warp (%) | 1.8 | 1.8 | 1.8 | JIS L1096-8.23.1 |
| | weft (%) | 10.8 | 10.6 | 10.4 | (B method) |
| Elastic modulus (recovery percentage of elongation) | | | | | |
| After 30 sec | warp (%) | 100.0 | 85.7 | 100.0 | JIS L1096-8.16.2 |
| After 30 sec | weft (%) | 84.4 | 82.4 | 86.2 | (B-1 method) |
| After 1 hr | warp (%) | 100.0 | 100.0 | 100.0 | |
| After 1 hr | weft (%) | 91.1 | 91.2 | 93.1 | |
| Change in dimensions (C method) | warp (%) | −0.5 | −0.1 | −0.3 | JIS L1096-8.39.1 |
| | weft (%) | −0.0 | 0.2 | −0.2 | (C method) |
| Change in dimensions after washing (104 method) | | | | | |
| 20 times | warp (%) | −1.2 | −1.2 | −1.5 | JIS L1930 (C3G method) |
| 20 times | weft (%) | −0.9 | −1.1 | −0.9 | |
| 20 times appearance (grade) | | 4-5 | 4-5 | 4-5 | |
| Pilling (A method) | 10 h (grade) | 4-5 | 4-5 | 4-5 | JIS L1076-8.1.1 (A method) |
| | 20 h (grade) | 4-5 | 4-5 | 4-5 | |
| | 30 h (grade) | 4-5 | 4-5 | 4-5 | |

As is clear from Table 2, the woven fabrics of the examples had properties comparable to those of the fabrics of the comparative examples.

Comparative Example 3

When the production was performed using the fasciated spinning apparatus shown in FIG. 1 in the same way as that of Example 1, except that the elastic multifilament yarn 9 serving as core component fibers was not supplied, the short fiber bundle was not conveyed to the swirling flow spindle 10, and thus yarn formation was not performed. Accordingly, it was seen that the multifilament yarn of the core component fibers serves as a connecting yarn and the short fibers A are conveyed to a swirling flow spindle in a state of being intertwined with the multifilament yarn and formed into a yarn.

INDUSTRIAL APPLICABILITY

A fabric produced from the multilayer structured spun yarn of the present invention is suitable for business suits, business uniforms, school uniforms, and the like. This fabric is also suitable for socks, gloves, whole garment knitted fabrics, and the like.

LIST OF REFERENCE NUMERALS

1 Fasciated spinning apparatus
2, 2' Front roller
3 Second roller
4 Third roller
5 Back roller
6 Draft zone
7 Sliver
8 Sliver guide
9 Elastic multifilament yarn
10 Spindle
11 Multilayer structured spun yarn
12 Slab catcher
13 Friction roller
14 Take-up drum
15 Cradle arm
16 Package

20 Multilayer structured spun yarn
21 Core component fiber
22 Inner layer fiber
23 Wound fiber
24 Sheath component fiber

The invention claimed is:

1. A multilayer structured spun yarn comprising core component fibers and sheath component fibers, wherein the core component fibers are a conjugated multifilament yarn, the sheath component fibers define a sheath inner layer and a sheath outer layer, with fibers of the sheath inner layer extending longitudinally with the core component fibers and being bundled by fibers of the sheath outer layer, which are wound therearound in one direction, the sheath component fibers are a blend of short fibers A including recycled animal hair fibers with an average fiber length of 10 to 25 mm and short fibers B with an average fiber length of longer than 25 mm and 51 mm or shorter, the short fibers B are a blend of virgin animal hair fibers and fibers other than animal hair fibers, the virgin animal hair fibers have an average fiber length of longer than 25 mm and 35 mm or shorter, and the fibers other than animal hair fibers have an average fiber length of longer than 25 mm and 51 mm or shorter, and a blending proportion of the short fibers A including the recycled animal hair fibers is 0.1 to 20 mass % with respect to 100 mass % of the multilayer structured spun yarn.

2. The multilayer structured spun yarn according to claim 1, wherein the short fibers A further include fibers other than the recycled animal hair fibers.

3. The multilayer structured spun yarn according to claim 1, wherein a blending proportion of a total of the recycled animal hair fibers and the virgin animal hair fibers is 5 to 50 mass % with respect to 100 mass % of the multilayer structured spun yarn.

4. The multilayer structured spun yarn according to claim 1, containing 10 to 40 mass % of the core component fibers and 60 to 90 mass % of the sheath component fibers with respect to 100 mass % of the multilayer structured spun yarn.

5. The multilayer structured spun yarn according to claim 1, wherein a single yarn of the multilayer structured spun yarn has a metric count in the range of 20 to 40 yarn count, and a fineness of 500 to 250 decitex.

6. Clothing comprising the multilayer structured spun yarn according to claim 1.

7. A method for producing a multilayer structured spun yarn, wherein the multilayer structured spun yarn contains core component fibers and sheath component fibers, the core component fibers are a conjugated multifilament yarn, the sheath component fibers define a sheath inner layer and a sheath outer layer, with fibers of the sheath inner layer extending longitudinally with the core component fibers and being bundled by fibers of the sheath outer layer, which are wound therearound in one direction, the sheath component fibers are a blend of short fibers A including recycled animal hair fibers with an average fiber length of 10 to 25 mm and short fibers B with an average fiber length of longer than 25 mm and 51 mm or shorter, the short fibers B are a blend of virgin animal hair fibers and fibers other than animal hair fibers, the virgin animal hair fibers have an average fiber length of longer than 25 mm and 35 mm or shorter, and the fibers other than animal hair fibers have an average fiber length of longer than 25 mm and 51 mm or shorter, and a blending proportion of the short fibers A including the recycled animal hair fibers is 0.1 to 20 mass % with respect to 100 mass % of the multilayer structured spun yarn, the method comprising:

opening the short fibers A with the average fiber length of 10 to 25 mm and the short fibers B with the average fiber length of longer than 25 mm and 51 mm or shorter using a carding machine, and blending the fibers A and B to form a sliver;

supplying the sliver to a draft zone of a spinning machine, and drafting the sliver;

supplying the conjugated multifilament yarn serving as the core component fibers to a point on an upstream side of front rollers in the draft zone, and combining the conjugated multifilament yarn with the sliver to form a fiber bundle; and supplying the fiber bundle to a spindle disposed at a distance from a discharge portion of the front rollers, processing the fiber bundle using a swirling flow, and then taking up the fiber bundle.

8. At least one fabric selected from a woven fabric and a knitted fabric, comprising a multilayer structured spun yarn, wherein the multilayer structured spun yarn contains core component fibers and sheath component fibers, the core component fibers are a conjugated multifilament yarn, the sheath component fibers define a sheath inner layer and a sheath outer layer, with fibers of the sheath inner layer extending longitudinally with the core component fibers and being bundled by fibers of the sheath outer layer, which are wound therearound in one direction, the sheath component fibers are a blend of short fibers A including recycled animal hair fibers with an average fiber length of 10 to 25 mm and short fibers B with an average fiber length of longer than 25 mm and 51 mm or shorter, the short fibers B are a blend of virgin animal hair fibers and fibers other than animal hair fibers, the virgin animal hair fibers have an average fiber length of longer than 25 mm and 35 mm or shorter, and the fibers other than animal hair fibers have an average fiber length of longer than 25 mm and 51 mm or shorter, and a blending proportion of the short fibers A including the recycled animal hair fibers is 0.1 to 20 mass % with respect to 100 mass % of the multilayer structured spun yarn.

9. Clothing comprising the at least one fabric according to claim 8.

* * * * *